US005100488A

United States Patent [19]

Sigworth

[11] Patent Number: 5,100,488

[45] Date of Patent: * Mar. 31, 1992

[54] THIRD ELEMENT ADDITIONS TO ALUMINUM-TITANIUM MASTER ALLOYS

[75] Inventor: Geoffrey K. Sigworth, Reading, Pa.

[73] Assignee: KB Alloys, Inc., Sinking Spring, Pa.

[ * ] Notice: The portion of the term of this patent subsequent to Mar. 14, 2006 has been disclaimed.

[21] Appl. No.: 397,891

[22] Filed: Aug. 24, 1989

Related U.S. Application Data

[60] Division of Ser. No. 165,036, Mar. 7, 1988, Pat. No. 4,873,054, which is a continuation-in-part of Ser. No. 904,511, Sep. 8, 1986, Pat. No. 4,812,290.

[51] Int. Cl.[5] ..... C22C 21/00

[52] U.S. Cl. ..... 148/437; 420/552

[58] Field of Search ..... 420/552, 550; 148/437

[56] References Cited

U.S. PATENT DOCUMENTS

| | | | |
|---|---|---|---|
| 3,961,995 | 6/1976 | Alliot et al. | 148/437 |
| 4,164,434 | 8/1979 | Fister, Jr. et al. | 428/687 |
| 4,710,348 | 12/1987 | Brupbacher et al. | 420/129 |
| 4,748,001 | 5/1988 | Banerji et al. | 420/528 |
| 4,751,048 | 6/1988 | Christodoulou et al. | 420/129 |
| 4,812,290 | 3/1989 | Sigworth | 420/552 |

FOREIGN PATENT DOCUMENTS

| | | |
|---|---|---|
| 66601/86 | 6/1986 | Australia . |
| 3527434A1 | 5/1985 | Fed. Rep. of Germany . |
| 2266746 | 9/1974 | France . |

OTHER PUBLICATIONS

Metals Handbook, 8th Ed., vol. 8 "Metalography Structures and Phase Diagrams," pp. 264, 344 (1973).

Davies, et al., "The Nucleation of Aluminum Grains in Alloys of Aluminum with Titanium and Boron," Metallurgical Transactions, vol. 1, pp. 275–280 (Jan. 1970).

*Primary Examiner*—R. Dean

*Assistant Examiner*—George Wyszomierski

*Attorney, Agent, or Firm*—Dickstein, Shapiro & Morin

[57] ABSTRACT

An improved aluminum-titanium master alloy is provided. Such alloy contains a small but effective amount of, in weight percent, carbon about 0.005 up to 0.05 titanium 2 to 15, and the balance aluminum. After melting, the master alloy is superheated to about 1200° C.–1300° C. to put the element into solution, then the alloy is cast in a workable form. The master alloy in final form is substantially free of carbides, sulfides, phosphides, nitrides, or borides greater than about 5 microns in diameter. The alloy of this invention is used to refine aluminum products that may be rolled into thins sheet, foil, or fine wire and the like. Such grain refined products are also substantially free of carbides, sulfides, phosphides, nitrides, or borides.

5 Claims, No Drawings

THIRD ELEMENT ADDITIONS TO ALUMINUM-TITANIUM MASTER ALLOYS

This application is a division of application Ser. No. 165,036, filed Mar. 7, 1988, now U.S. Pat. No. 4,873,054, which is a continuation-in-part of Ser. No. 904,511 filed Sept. 8, 1986 which issued as U.S. Pat. No. 4,812,290 on Mar. 14, 1989.

BACKGROUND OF THE INVENTION

This application is a continuation-in-part of pending Ser. No. 904,511 filed on Sept. 8, 1986.

This invention relates to aluminum-titanium master alloys which are used for the grain refining of aluminum. More particularly, the invention relates to the addition of carbon and other third elements to the master alloy to improve its ability to grain refine.

A very limited amount of experimental work is reported in the scientific literature. A. Cibula (in an article entitled "The Mechanism of Grain Refinement of Sand Castings in Aluminium Alloys," written in the *Journal of Institute of Metals*, vol. 76, 1949, pp. 321-360) indicates that carbon in the master alloy does in fact influence grain refining. In the 1951-52 *Journal of Institute of Metals*, vol. 80, pp. 1-16, Cibula reported further work in the article, "The Grain Refinement of Aluminium Alloy Castings by Additions of Titanium and Boron". As indicated in the title, the effect of adding B and C to Al-Ti master alloys was studied. The results of this work on the effect of carbon is quoted directly from his paper:

"Although the results obtained above with titanium carbide additions confirmed that it is possible to produce grain refinement with much smaller titanium additions than are normally used, *no method of practical value was found*. (Emphasis added.) The results showed that the obstacles in increasing the carbon content of aluminium [sic] titanium alloys are largely caused by the difficulty of achieving intimate contact and wetting between carbon or titanium carbide and molten aluminium, either due to interference by oxide films or to inherently unsuitable angles of wetting. It has been suggested that one way of avoiding the difficulty would be by pre-wetting titanium carbide powder by sintering with nickel or cobalt powder, but the high melting point of these metals would be inconvenient with aluminium alloys and bridging between carbide particles might prevent their complete dispersion."

"The introduction of carbon into molten aluminium-titanium alloys is also limited by the low solubility of carbon in the melt, for any excess of carbide would tend to remain where it was formed, in contact with the source of carbon, instead of dispersing in the melt, unless the carbide could be precipitated in the liquid metal."

"In the work described in the next section on the use of titanium boride instead of titanium carbide, the difficulties described above were overcome by using separate aluminium-titanium and aluminium-boron hardener alloys: by this means it was possible to precipitate the boride particles in the melt and control the excess of either constituent. This could not be done with titanium carbide additions *because carbon cannot be alloyed with aluminum*."(Emphasis added.)

F.A. Crossley and L.F. Mondolfo reported experiments in the *Journal of Metals*, 1951, vol. 3, pp. 1143 ∝ 1148. They found that the addition of $Al_4C_3$, or graphite, to aluminum titanium melts resulted in a decrease in grain refining effect.

Further experiments in the art were recorded in 1968 by E.L. Glasson and E.F. Emley in an article in the book entitled "Solidification of Metals" (ISI Publication No. 110, 1968), pp. 1-9. In this article, Glasson and Emley reported that $C_2Cl_6$, or graphite, may be incorporated into salt tablets to improve grain refining by forming titanium carbide.

Further experiments in this area of research were reported by Y. Nakao, T. Kobayashi, and A. Okumura in the Japanese *Journal of Light Metals*, 1970, vol. 20, p. 163. Nakao and co-workers achieved essentially similar results by incorporating titanium carbide powder in a salt flux.

More recent experiments were reported in an article in the *Journal of Crystal Growth*, 1972, vol. 13, p. 777 by J. Cisse, G.F. Bolling, and H.W. Kerr. In this paper, the nucleation of aluminum grains was observed on massive titanium carbide crystals, and it was established that the following epitaxial orientation relationship exists:

$$(001)_{Al} \,||\, (011)_{TiC};[001]Al \,||\, [001]_{TiC}$$

More recently, A. Banerji and W. Reif briefly described an Al-6%Ti-1.2%C master alloy in *Metallurgical Transactions*, vol. 16A, 1985, pp. 2065-2068. This alloy was observed to grain refine 7075 alloy, and a patent application (No. 8505904 dated 3/1/85) was filed in the U.K.

A review of the scientific literature indicates that the problem has not been solved. Although there are indications that carbon may be beneficial in the grain refining of aluminum, massive carbides are found within the final product. This difficulty is summarized most succinctly in the second and third paragraphs of the above quotation from Cibula's 1951 study, and explains why boron, not carbon, has found commercial application as a third element in Al-Ti master alloys. Large, hard, insoluble particles cannot be present in master alloys used to refine alloys used in the manufacture of thin sheets, foil, or can stock large particles in thin products cause pinholes and tears.

This is essentially the crux of the problem: massive hard particles have prevented the development of an effective aluminum master alloy containing carbon. This invention has solved the problem.

SUMMARY OF THE INVENTION

It is an object of this invention to provide an improved grain refiner for aluminum that may be introduced into aluminum casting alloys to produce final products such as thin sheet, foil, or fine wire without concern for product degradation.

Another object is to provide an aluminum-titanium master alloy that contains certain third elements, such as carbon, which thereby act to enhance the grain refining effectiveness of aluminum-titanium master alloys.

Still another object is a process of producing a grain refiner in which the carbon, or other third element, is in solution in the matrix rather than being present as massive hard particles.

Additional objects of the invention are to provide a grain refined cast aluminum alloy free of hard particles that would render the alloy unacceptable and a method of producing such an alloy.

Additional objects and advantages of the invention will be set forth in the description that follows, and in part will be obvious from the description, or may be learned by practice of the invention. The objects and advantages of the invention will be attained by means of the instrumentalities and combinations particularly pointed out in the appended claims.

To achieve the objects and in accordance with the purpose of the invention, as embodied and broadly described herein, an aluminum-titanium master alloy is disclosed herein. This master alloy consists essentially of, in weight percent, one or more elements selected from the group consisting of carbon about 0.003 up to 0.1, sulfur about 0.03 up to 2, phosphorus about 0.03 up to 2, nitrogen about 0.03 up to 2, and boron about 0.01 up to 0.4, titanium 2 to 15, and the balance aluminum plus impurities normally found in master alloys. This master alloy is substantially free of carbides, sulfides, phosphides, nitrides, or borides greater than about 5 microns in diameter. Preferably, the additional element is carbon.

The invention also provides a method of making the aluminum-titanium master alloy by preparing an alloy consisting essentially of, in weight percent, one or more elements selected from the group consisting of carbon about 0.003 up to 0.1, sulfur about 0.03 up to 2, phosphorus about 0.03 up to 2, nitrogen about 0.03 up to 2, and boron about 0.01 up to 0.4, titanium 2 to 15, and the balance aluminum plus impurities normally found in master alloys; superheating the alloy to a temperature and for a time sufficient to place the element or elements into solution in the alloy; and casting the alloy. Preferably, the alloy is superheated to a temperature greater than about 1150° C. and most preferably from about 1200° C. to about 1300° C.

The invention further provides a grain refined aluminum alloy substantially free of carbides, sulfides, phosphides, nitrides, or borides greater than about 5 microns in diameter. Such grain refined aluminum alloys are produced by the addition of the claimed master alloy to a molten mass of aluminum.

DESCRIPTION OF THE INVENTION

Reference will now be made in detail to the presently preferred embodiments of the invention, which, together with the following examples, serve to explain the principles of the invention.

The present invention relates to an aluminum master alloy containing titanium and a third improving element (or elements) in a small but effective amount (up to 0.1% for carbon). The improving element has been placed into solution in the matrix during a high temperature liquid state solutionizing step in the preparation of the master alloy, so that the product, upon subsequent solidification, is substantially free of second-phase particles comprised of the third element or its intermetallics greater than about 5 microns in diameter.

Although carbon is preferred, the third effective element in solution may be sulfur, phosphorus, boron, nitrogen, or the like. Using the method of the claimed invention, boron has been found to provide effective grain refining when present in the claimed master alloy in amounts less than commercial aluminum-titanium-boron master alloys. For the best combination of grain refining effectiveness, process control, and control of coarse, hard particles, the third element is present in controlled amounts: within the range 0.003% to 0.1% for carbon, 0.01% to 0.4% for boron, and 0.03% to 2% for the other elements. Most preferably, the weight percent of carbon is from about 0.005 to about 0.05.

The master alloys of the claimed invention also include aluminum-titanium alloys which contain two or more of the effective third elements. In other words, such alloys contain any two or more of the elements of the group consisting of carbon, sulfur, phosphorus, boron, and nitrogen in the amounts previously specified for each. Such alloys are substantially free of second phase particles comprised of such two or more third elements or their intermetallics greater than about 5 microns in diameter. Such combinations permit the design of master alloys that combine the different grain-refining qualities of the various third elements disclosed herein, and that take advantage of synergistic effects arising from the combination of such third elements.

For example, in a preferred embodiment, carbon is present in a weight percent range from about 0.003 to less than 0.1 and sulfur is present in a weight percent range of about 0.03 to 2. This combination gives the excellent grain refining provided by carbon and the faster acting grain refining provided by sulfur.

In an alternative preferred embodiment, the aluminum-titanium master alloy contains both carbon and boron in the weight percent range of about 0.003 to less than 0.1 for carbon and 0.01 to 0.4 for boron. The carbon provides excellent grain refining and acts reasonably fast, while the boron is slower acting, but longer lasting.

The master alloy is prepared by melting aluminum and introducing the desired alloying elements at standard processing temperatures. The alloy is then superheated to greater than about 1150° C. (preferably about 1200° C. to 1300° C.) for at least about 5 minutes for the solutioning processing step to be completed. Preferably, the master alloy is superheated in an environment, such as a crucible chamber or other vessel, which is substantially free of carbides, sulfides, phosphides, borides, or nitrides. Most preferably, the master alloy is superheated in a crucible chamber, which includes thermocouple protection tubes and the like, lined with relatively inert materials, such as aluminum oxide, beryllium oxide, or magnesium oxide.

The master alloy is then cast and finally prepared in forms normally marketed in the art using known techniques. These forms include waffle, cast, extruded or rolled rod, and the like. The master alloy is substantially free of particles comprised of carbides, sulfides, phosphides, nitrides, or borides greater than about 5 microns in diameter as determined by known quality control procedures, wherein the examination of a 1 $cm^2$ longitudinal micropolished sample of the alloy under a light microscope at 200x magnification will show no more than 2 of such particles greater than about 5 microns in diameter.

The claimed master alloys are then used to grain refine aluminum by adding such alloys to a molten mass of the aluminum by known techniques to produce a grain refined aluminum alloy. Such molten mass may also have additional alloying elements. The grain refined aluminum alloy is substantially free of carbides, sulfides, phosphides, nitrides, or borides, resulting from the addition of the master alloy, that are greater than about 5 microns in diameter. Such grain refined alloy preferably has an aluminum grain size of about 200–300 microns.

Such grain refined aluminum alloys are cast, rolled, drawn, or otherwise further processed using known techniques into forms normally used in the art. These forms include fine wire or packaging material, such as foil and sheet. Particular types of packaging material include beverage, body, and lid stock and food can stock. A preferred body stock is 3004 body stock, and a preferred lid stock is 5182 end stock. Food can stock comprises aluminum alloys that are intermediate in magnesium content between 3004 body stock and 5182 end stock.

EXAMPLES OF THE INVENTION

Six examples of this invention, and one example of a prior art alloy, are given below to illustrate the scope of this discovery. Each example was produced in a small laboratory furnace by melting aluminum and reacting with reagents. All alloys have essentially the same nominal titanium composition, 5 percent by weight.

1. An Example of a Prior Art Alloy

An Al-5%Ti alloy was made by reacting 3 kg of 99.9%AI and 860 grams of $K_2TiF_6$. The aluminum was melted and brought to 760° C. A stirring paddle was immersed in the melt and allowed to rotate at 200 revolutions per minute. The potassium fluotitanate salt was fed to the surface of the melt and allowed to react for 15 minutes. At the end the salt was decanted and the material poured into waffle form. The grain refining ability of this alloy is shown in Table I. Grain sizes of about 1000 microns are found at short contact times.

2. Al-Ti-S Master Alloy

An Al-Ti-S alloy was prepared by melting 3 kg of aluminum and bringing it to a temperature of 760° C. A mixture of 860 grams of $K_2TiF_6$ and 50 grams of ZnS was fed to the surface of the melt and allowed to react. The spent salt was decanted and the material cast off into waffle. The waffle was remelted in an induction furnace lined with an alumina crucible, heated to 1250° C., and cast into waffle. The grain sizes obtained with this master alloy are shown in Example 2 of Table I. As one can see, the presence of sulfur markedly increases the ability of the alloy to grain refine. Grain sizes as low as 251 microns at short times were obtained with this master alloy. The master alloy containing sulfur is fast acting, but its action begins to fade at times longer than 10 minutes, when larger grain sizes are observed.

3. An Al-Ti-N Master Alloy

A mixture of 860 grams of $K_2TiF_6$ and 50 grams of TiN were fed to 3 kg of molten aluminum held at a temperature of 760° C. The salt was allowed to react and then decanted from the surface of the melt, whereupon the alloy was cast into waffle. The resulting Al-Ti-N alloy was placed in an induction furnace, which was lined with an aluminum oxide crucible and heated to 1250° C. and cast into waffle. The resulting ingot gave the grain size response shown in Example 3 of Table I. Although not as effective as sulfur, nitrogen does improve the performance of the alloy, giving grain sizes of approximately 450–600 microns at short times.

4. Al-Ti-P Master Alloy

Three (3) kg of 99.9%AI was melted and 50 grams of a Cu-6%P alloy were added to the melt. Subsequently, 860 grams of $K_2TiF_6$ was fed to the surface of the melt, with stirring, and the salt was allowed to react with the aluminum. The salt was decanted, and the alloy was cast. It was subsequently remelted in an induction furnace lined with an aluminum oxide crucible and heated to and cast from 1250° C. The waffle made in this fashion gave the grain sizes shown in Example 4 of Table I. It can be seen that the alloy is roughly equivalent to that produced with nitrogen, and much better than a prior art Al-Ti alloy which does not contain the third element addition.

5. Al-Ti-C Master Alloy

A charge of 9,080 grams of aluminum was melted in an induction furnace and brought to 750°–760° C., whereupon a mixture of 200 grams of $K_2TiF_6$ of and 25 grams of $Fe_3C$ was fed to the surface of the melt and allowed to react. Subsequently, 730 grams of Ti sponge was added to the melt and allowed to react. The maximum temperature obtained during the reaction was 970° C. The salt was decanted, the heat transferred to a furnace containing an oxide crucible, and the carbon placed in solution by bringing the alloy to a temperature of 1250° C. The grain refining ability of this alloy is shown in Example 5 of Table I. Extremely fine grain sizes are obtained at the 0.01%Ti addition level; grain sizes of 300 microns or less were obtained at contact times of one-half to 10 minutes. At longer times, some fading of the grain refiner's action was observed.

6. Al-Ti-C Alloy

This alloy was made in exactly the same fashion as Example 5 above, only carbon was added with the as $K_2TiF_6$ as 2½ grams of carbon black, instead of using iron carbide. The maximum temperature obtained, after the Ti sponge addition, was 890° C. Waffle cast from 1250° C. gave the grain refining performance shown in Example 6 of Table I. Extremely fine grain sizes were found at contact times of one-half to 10 minutes. The results obtained here were similar to those found in Example 5.

7. Al-Ti-B Master Alloy

Three alloys were produced by feeding $K_2TiF_6$—$KBF_4$ salt mixtures to stirred aluminum baths held at 750° C. When the salt was completely reacted, it was decanted, and the master alloy was poured off. It was then transferred to an induction furnace lined with an alumina crucible and heated to 1250° C. Half the heat was poured out into waffle. The remaining half was heated to 1300° C. and cast into waffle. Three aim chemical compositions were employed: 5%Ti-0.2%B, 5%Ti-0.1%B, and 5%Ti-0.05%B.

The alloys obtained and their grain refining responses are summarized in Table II. The resulting boron compositions indicate that boron acts similar to carbon, although about ten times as much is required for the same effect. Also, these alloys are slower acting, giving best results at 20 to 30 minutes.

The structure of the alloys was not found to vary with the narrow range of casting temperatures employed. The $TiAl_3$ phase was seen to be present as long "feathery" dendritic needles. The structure in all samples was similar at first glance, but careful study of the three alloys showed that the higher boron content promoted a finer dendritic structure of $TiAl_3$.

DISCUSSION OF RESULTS

It is clear from the results of these examples, as well as from the results of other heats produced in the course of experimentation, that the controlled addition of third elements can have a marked beneficial effect on the gr in refining ability of Al-Ti master alloys. The means by which the titanium or the third element is added to the aluminum does not appear to be important, so long as the resulting alloy is superheated to over 1150° C. For example, carbon has been placed into the master alloy by the introduction of powdered graphite, carbon black, and metal carbides. All work equally well. It is-important only to introduce a small but controlled amount of the third element in order to obtain the best results. This is usually done at low temperatures because the recovery of Ti and the third element is usually more predictable at the low temperature and because the reaction proceeds very smoothly. The reaction temperature is not critical, however. No change in the range of 700°-900° C. was observed.

The third element is then placed into solution by bringing the melt, which is now held in an inert crucible, to extremely high temperature (over 1150° C. and preferably about 1200° C. to 1300.C). The alloy is cast from the high temperature, and a superior grain refiner is produced.

From these results and other teachings disclosed herein, it will be apparent to those skilled in the art that various combinations of two or more third improving elements may be useful. For example, the presence of boron in Al-Ti master alloys produces a slow acting, but long lasting refinement of grains in the final cast aluminum alloy. On the other hand, the use of carbon or sulfur produces fast acting grain refiners that fade quickly. Thus, it is to be expected that the effects of using more than one of the third improvement elements are additive. Hence, a Al-Ti-C-B and an Al-Ti-S-B, or an Al-Ti-C-S-B, master alloy can be expected to be both fast acting and long lasting. Likewise, other useful combinations can be envisioned.

It will be apparent to those skilled in the art that various modifications and variations can be made to the processes and products of the present invention. Thus, it is intended that the present invention cover such modifications and variations, provided they come within the scope of the appended claims and their equivalents.

TABLE I

GRAIN REFINING RESPONSE OF Al-Ti AND Al-Ti THIRD ELEMENT MASTER ALLOYS (0.01% Ti added to 99.7% Al held at 730° C.)

| Example No. | Alloy Type | Waffle Cast in Heat No. | Grain Size* at Various Contact Times** (min.) 0 | ½ | 1 | 2 | 5 | 10 | 25 | 50 | 100 |
|---|---|---|---|---|---|---|---|---|---|---|---|
| 1 | Al-Ti | 541-44 | >2000 | 1000 | 921 | 1093 | 1060 | 1060 | 1400 | — | — |
| 2 | Al-Ti-S | 563-13B | >2000 | 460 | 333 | 251 | 275 | 388 | 538 | 921 | 853 |
| 3 | Al-Ti-N | 563-13A | >2000 | 564 | 500 | 530 | 460 | 583 | 686 | 833 | 1129 |
| 4 | Al-Ti-P | 563-13C | >2000 | 648 | 603 | 583 | 492 | 416 | 744 | 1296 | 1750 |
| 5 | Al-Ti-C | 563-15A | >2000 | 313 | 282 | 336 | 257 | 321 | 593 | 564 | 564 |
| 6 | Al-Ti-C | 563-15B | >2000 | 243 | 246 | 238 | 286 | 296 | 479 | 714 | 660 |

*Grain size is the average intercept distance, in microns, as measured according to ASTM Procedure E112.
**The "contact time" is the time elapsed since the master alloy addition to the melt; or the time the master alloy is in "contact" with the melt.

TABLE II

SUMMARY OF TEST RESULTS WITH EXPERIMENTAL LOW BORON ALLOY WAFFLE CAST FROM HIGH TEMPERATURE

| ALLOY % TI | % B | CASTING TEMPERATURE | HEAT NO. | GRAIN SIZE* (AID, m) AT VARIOUS CONTACT TIMES (MIN) 1 | ½ | 1 | 2 | 5 | 10 | 25 | 50 | 100 | 150 |
|---|---|---|---|---|---|---|---|---|---|---|---|---|---|
| 4.11 | 0.01 | 1250° C. | 574-87 | 2000 | 1060 | 1000 | 897 | 714 | 530 | 564 | 573 | 795 | 729 |
| 4.11 | 0.01 | 1300° C. | 574-87 | 2000 | 1093 | 714 | 700 | 437 | 500 | 479 | 486 | 593 | 406 |
| 5.87 | 0.06 | 1250° C. | 574-86 | 2000 | 564 | 555 | 448 | 479 | 492 | 397 | 411 | 393 | 460 |
| 5.87 | 0.06 | 1300° C. | 574-86 | 2000 | 614 | 636 | 448 | 432 | 353 | 460 | 333 | 421 | 492 |
| 5.19 | 0.14 | 1250° C. | 574-85 | 2000 | 346 | 360 | 275 | 339 | 353 | 294 | 261 | 309 | 336 |
| 5.19 | 0.14 | 1300° C. | 574-85 | 2000 | 330 | 397 | 346 | 368 | 364 | 238 | 248 | 234 | 273 |

*Grain size measured by standard KBI test: nominal 0.01% Ti addition to 99.7% Al at 1350° F.

What is claimed is:

1. An aluminum-titanium master alloy produced by the method comprising the steps of:

preparing an alloy consisting essentially of, in weight percent, carbon 0.005 to 0.05, titanium 2 to 15, and the balance aluminum plus impurities normally found in master alloys;

superheating the alloy to a temperature greater than about 1150° C. and for a time sufficient to place the carbon into solution in the alloy; and casting the alloy to produce a master alloy consisting essentially of, in weight percent, carbon 0.005 to 0.05, titanium 2 to 15, and the balance aluminum plus impurities normally found in master alloys, wherein the alloy is substantially free of carbides greater than about 5 microns in diameter.

2. The alloy of claim 1 wherein the alloy is superheated to a temperature from about 1200° C. to about 1300° c.

3. The alloy of claim 1 wherein the alloy is superheated in an inert crucible substantially free of carbon and its intermetallics.

4. The method of claim 3 wherein the crucible is composed of aluminum oxide, beryllium oxide, or magnesium oxide.

5. An aluminum-titanium master alloy consisting essentially of, in weight percent, carbon from about 0.005 to about 0.05, titanium 2 to 15, and the balance aluminum plus impurities normally found in master alloys, wherein said master alloy is substantially free of carbides greater than about 5 microns in diameter.

* * * * *